US006228475B1

(12) United States Patent
Chu et al.

(10) Patent No.: US 6,228,475 B1
(45) Date of Patent: May 8, 2001

(54) INK JET RECORDING ELEMENT

(75) Inventors: Lixin Chu; Charles E. Romano, Jr., both of Rochester, NY (US); Cheng C. Chen, East Brunswick, NJ (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/145,364

(22) Filed: Sep. 1, 1998

(51) Int. Cl.[7] ..... B41M 5/00; B41J 2/01

(52) U.S. Cl. ..... 428/304.4; 347/105; 428/195; 428/331

(58) Field of Search ..... 428/195, 331, 428/522, 500, 304.4; 347/105

(56) References Cited

U.S. PATENT DOCUMENTS 5,372,884 * 12/1994 Abe et al. ..... 428/331
5,605,750 2/1997 Romano ..... 428/304.4
5,683,793 * 11/1997 Malhotra et al. ..... 428/195
5,693,410 * 12/1997 Malhotra et al. ..... 428/195

FOREIGN PATENT DOCUMENTS 813 978 A1 12/1997 (EP) .
224580 * 11/1985 (JP) .

* cited by examiner

*Primary Examiner*—Pamela R. Schwartz
(74) *Attorney, Agent, or Firm*—Harold E. Cole

(57) ABSTRACT

An ink jet recording element comprising a support having thereon the following layers in the order recited:

I) a solvent-absorbing layer of a porous, polyolefin material, and

II) an image-recording layer comprising a polymeric binder and colloidal silica having an attached silane coupling agent.

20 Claims, No Drawings

INK JET RECORDING ELEMENT

FIELD OF THE INVENTION

The present invention relates generally to an ink jet image-recording element which yields printed images with high optical densities, excellent image quality, good water fastness, and fast drying.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light It is desirable to use a porous material in an ink jet recording element due to its liquid-absorbing capability which yields effective drying. This fast dry-time can enhance the printing efficacy, and in many cases, can improve the printing quality by eliminating the bleeding of two adjacent colors in the print.

DESCRIPTION OF RELATED ART

U.S. Pat. No. 5,605,750 relates to a microporous ink jet recording element comprising a support having thereon a solvent-absorbing microporous material layer and an image-recording layer of a porous, pseudo-boehmite.

However, there is a problem using this element in that the printed images obtained on this porous support material are often of low optical density and poor color gamut due to the immersion of the colorants into pores of the support.

EP 813 978 A1 relates to an ink jet recording element wherein a support is coated with an ink absorption layer containing solid fine particles, a hydrophilic binder and oil drops. However, there is no disclosure in this reference of the use of a porous solvent-absorbing underlayer as employed in the present invention.

SUMMARY OF THE INVENTION

In accordance with the present invention, there is provided an ink jet recording element comprising the following layers in the order recited:

I) a solvent-absorbing layer of a porous, polyolefin material, and

II) an image-recording layer comprising a polymeric binder and colloidal silica having an attached silane coupling agent.

The porous material employed provides the capability of absorbing liquid from the ink, which ensures fast drying of the ink after printing and eliminates the bleeding between two adjacent colors. Further, the image-recording layer will hold colorants in the top portion of the element to yield a high color density.

DETAILED DESCRIPTION OF THE INVENTION

In a preferred embodiment of the invention, the porous, polyolefin material is a microporous material comprising:

(a) a matrix of polyolefin;

(b) finely-divided, substantially water-insoluble filler particles, preferably of which at least about 50 percent by weight are siliceous particles, the filler particles being distributed throughout the matrix and constituting from about 40 to about 90 percent by weight of the microporous material; and (c) a network of interconnecting pores communicating substantially throughout the microporous material, the pores constituting from about 35 to about 95 percent by volume of the microporous material.

In another preferred embodiment of the invention, the colloidal silica having an attached silane coupling agent has the formula:

$$(R^1)_n Si(OR^2)_{4-n}$$

wherein:

each $R^1$ independently represents a substituted or unsubstituted alkyl group having from 1 to about 10 carbon atoms with at least one $R^1$ having at least one amino group, such as $NH_2(CH_2)_3$, $NH_2(CH_2)_4$, $NH_2(CH_2)_2NH(CH_2)_2$, $NH_2(CH_2)_2NH(CH_2)_3$, $HN_2(CH_2)_2HNCH_2(C_6H_4)(CH_2)_2$, $NH_2(CH_2)_6NH(CH_2)_3$, $NH_2(CH_2)_3OC(CH_3)_2CHCH$, $C_6H_5NH(CH_2)_2NH(CH_2)_3$, $CH_3CH_3N(CH_2)_3$, $CH_3NH(CH_2)_3$, or $CH_2CHC_6H_4CH_2N^+H_2Cl^-(CH_2)_3$;

each $R^2$ independently represents an alkyl group having from 1 to about 4 carbon atoms, such as methyl, ethyl, etc.; and n is from 1 to 3.

In yet another preferred embodiment, in the above formula, $R^1$ is $H_2NCH_2CH_2HN(CH_2)_3$ and $CH_3$, each $R^2$ is $CH_3$ and n is 2.

In still other preferred embodiment, the colloidal silica having an attached silane coupling agent and the polymeric binder are both cationic.

The porous or microporous material may be thick enough to act as a support for the image-recording layer without the need for a separate support.

However, if a thin layer of the porous or microporous material is used, then a support is necessary to provide rigidity and dimensional stability. Good results are obtained when the porous or microporous material is laminated to the support.

The supports or substrates which may be used in the recording elements of the present invention are usually opaque and may include, for example, ordinary plain papers, resin-coated papers, cloth, wood, metal plates, opaque films and otherwise transparent supports such as, for example, films or sheets of polyester resins, diacetate resins, triacetate resins, acrylic resins, polycarbonate resins, polyvinyl chloride resins, polyimide resins, etc., which have fillers added to render them opaque.

The support is suitably of a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the image-recording layer to the solvent-absorbing layer, the surface of the solvent-absorbing layer may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface of a support if one is used to increase adhesion of the solvent-absorbing layer. If a subbing layer is used, it should have a thickness (i.e., a dry coat thickness) of less than about 2 $\mu$m.

Optionally, an additional backing layer or coating may be applied to the backside of a support (i.e., the side of the support opposite the side on which the solvent-absorbing layer and the image-recording layer are coated) if one is used, for the purposes of improving the machine-handling properties of the recording element, controlling the friction and resistivity thereof, and the like. Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 2 percent by weight of the binder component and the average particle size of the filler material is in the range of 5 to 15 $\mu$m, preferably 5 to 10 $\mu$m. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octylsulfonate potassium salt, oligostyrenesulfonate sodium salt, laurylsulfosuccinate sodium salt, and the like.

The antistatic agent may be added to the binder composition in an amount of 0.1 to 15 percent by weight, based on the weight of the binder.

The image-recording layer may be present in an amount of from about 1 to about 40 g/m$^2$, preferably from about 4 to about 20 g/m$^2$, which corresponds to a dry thickness of about 0.5 to about 20 $\mu$m, preferably about 2 to about 10 $\mu$m. The dry thickness of the solvent-absorbing layer is from about 25 to about 450 $\mu$m, preferably from about 50 to about 250 $\mu$m.

Suitable polyolefins useful in the invention include polypropylene, polyethylene, polymethylpentene, and mixtures thereof. Polyolefin copolymers, including copolymers of ethylene and propylene, are also useful. Preferred polyolefin materials include essentially linear ultrahigh molecular weight (UHMW) polyethylene having an intrinsic viscosity of at least 10 deciliters/gram, essentially linear UHMW propylene having an intrinsic viscosity of at least about 6 deciliters/gram, or a mixture thereof.

Many process are known for producing the porous or microporous polyolefin which may be employed in the present invention. Such processes are exemplified by WO 97/22467 and U.S. Pat. Nos. 5,605,750 and 5,244,861, the disclosures of which are hereby incorporated by reference.

Many of the microporous materials used in the recording elements of the present invention are available commercially. Examples include a polyethylene polymer-containing material sold by PPG Industries, Inc., Pittsburgh, Pa. under the trade name of Teslin®, Tyvek® synthetic paper (DuPont Corp.), natural pulp paper, and OPPalyte® films (Mobil Chemical Co.) and other composite films listed in U.S. Pat. No. 5,244,861 disclosed above.

The matrix of the microporous material employed in the invention consists of a porous polyolefin which can be extruded, calandared, pressed, or rolled into film, sheet, strip, or web.

As present in the microporous material useful in the invention, the finely-divided, substantially water-insoluble filler particles may be in the form of ultimate particles, aggregates of ultimate particles, or a combination of both. In general, at least about 90 percent by weight of the siliceous particles used in preparing the microporous material have gross particle sizes in the range of from about 5 to about 40 $\mu$m, preferably from about 10 to about 30 $\mu$m. It is expected that the sizes of filler agglomerates may be reduced during processing of the ingredients to prepare the microporous material. Accordingly, the distribution of gross particle sizes in the microporous material may be smaller than in the raw siliceous filler itself.

Examples of suitable siliceous particles useful in the invention include particles of silica, mica, montmorillonite, kaolinite, asbestos, talc, diatomaceous earth, vermiculite, natural and synthetic zeolites, cement, calcium silicate, aluminum silicate, sodium aluminum silicate, aluminum polysilicate, alumina silica gels, and glass particles. In a preferred embodiment, silica such as precipitated silica, silica gel, or fumed silica, and clays are employed.

In addition to the siliceous particles, finely-divided, substantially water-insoluble non-siliceous filler particles may also be employed. Examples of such optional non-siliceous filler particles include particles of titanium oxide, iron oxide, copper oxide, zinc oxide, antimony oxide, zirconia, magnesia, alumina, molybdenum disulfide, zinc sulfide, barium sulfate, strontium sulfate, calcium carbonate, magnesium carbonate, magnesium hydroxide, and finely divided substantially water-insoluble flame retardant filler particles such as particles of ethylenebis(tetra-bromophthalimide), octabromodiphenyl oxide, decabromodiphenyl oxide, and ethylenebisdibromonorbornane dicarboximide.

As present in the microporous material, the finely-divided, substantially water-insoluble non-siliceous filler particles may be in the form of ultimate particles, aggregates of ultimate particles, or a combination of both. In general, at least about 75 percent by weight of the non-siliceous filler particles used in preparing the microporous material have gross particle sizes in the range of from about 0.1 to about 40 $\mu$m.

In general, the solvent-absorbing microporous layer will cover the entire side of one surface of the support in the form of a separate and distinct layer. However, there may be instances where it is desirable that the solvent-absorbing layer cover only a portion of the support as, for example, where it is desired that the solvent-absorbing layer adhere to the support in the form of one or more spots, patches, strips, bars, etc., or the like. In those instances, the image-recording layer may cover all of the support including the solvent-absorbing layer or just the solvent-absorbing layer itself depending upon the type of effect one wishes to create.

In a preferred embodiment of the invention, the polymeric binder employed in the image-recording layer comprises a water-soluble or water-dispersible polymer. In another preferred embodiment, the polymeric binder is a polyamide, a polyethyleneimine, a polyacrylamide, a cationic-modified polyvinyl alcohol, a polyvinyl pyridine, an amino-substituted polyacrylate, an amino-substituted polyether or an amino-substituted polyester.

In another preferred embodiment of the invention, the image-recording layer also contains a mordant which can be a dimethylamino ethyl methacrylate copolymer; poly(vinyl benzyl trimethyl ammonium chloride); poly(diallyl dimethyl ammonium chloride); or poly(methacryloxyethyl hydroxy ethyl dimethyl ammonium chloride) quaternary copolymer.

In the present invention, when the ink is ejected from the nozzle of the ink jet printer in the form of individual droplets, the droplets pass through the image-recording layer where most of the dyes in the ink are retained or mordanted while the remaining dyes and the solvent or carrier portion of the ink pass freely through the image-recording layer to the solvent-absorbing layer where they are rapidly absorbed by the porous or microporous material. In this manner, large volumes of ink are quickly absorbed by the recording elements of the present invention giving rise to high quality recorded images having excellent optical density and good color gamut.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The image-recording layer used in the recording elements of the present invention can also contain various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV-absorbing agents; mildew-proofing agents; mordants; antistatic agents, anti-oxidants, optical brighteners, and the like. Such additives can be selected from known compounds or materials in accordance with the objects to be achieved.

The following examples are provided to illustrate the invention.

EXAMPLES

Example 1 (Invention)

A coating suspension was prepared by mixing 11.25 g of 40 wt % silica colloidal suspension (Ludox AS-40® (DuPont Corp.) and 85 g water. In turn, 0.9 g of N-(2-aminoethyl)-3-aminopropylmethyldimethoxysilane, 2.5 g of Kymene® 450 polyamide (20 wt %), (Hercules Corp.), 0.2 g of 50 wt % polyethyleneimine solution (Aldrich Chemicals Co.), and 0.1 g of Surfynol 104D surfactant (Air Products Inc.) were added under stirring. The suspension was coated onto Teslin 7® SP (PPG Industries) (no separate support was used) by a means of extrusion coating machine. The coverage of the dried solid was 3.0 g/m$^2$.

Example 2 (Invention)

A coating suspension was prepared by mixing 18 g of 40 wt % silica colloidal suspension, Nalco® 1060 (Nalco Corp.) and 73 g of water. In turn, 0.9 g of N-(2-aminoethyl)-3-aminopropylmethyldimethoxysilane, 8 g of Kymene 557H® polyamide (20 wt %), (Hercules Corp.), and 0.03 g of Zonyl® FS-300 surfactant (DuPont Corp.) were added under stirring. The suspension was coated onto Teslin® by a means of extrusion coating machine. The coverage of the dried solid was 5.0 g/m$^2$.

Comparative Example 1

A coating suspension was prepared by mixing 26.7 g of 20 wt % colloidal silica (Ludox® AS-40) and 84 g of water. Then 8.9 g of 3 wt % polyvinylalcohol solution (Airvol® 350, Air Products Corp.) and 0.3 g of Surfynol® 104D was added to the suspension under stirring. The suspension was coated onto Teslin® 10 SP the same way as in Example 1. The colloidal silica in this example did not have an attached silane coupling agent.

Comparative Example 2

Teslin® 10 SP was used as an image-recording element without applying an image-recording layer.

The above wet coatings were air flow dried at 40° C. After drying, the coated sheets were cut.

Images were formed on the recording elements prepared as described above using a Hewlett-Packard Desk Writer 690 Color Ink jet Printer. The images comprised a series of cyan, magenta, yellow and black patches, each patch being in the form of a rectangle 0.59 cm in length and 0.19 cm in width.

The optical densities of the imaged areas of the above recording elements were measured using an X-Rite® Photographic Densitometer. A densitometer is an optical instrument used to measure the lightness or darkness of an image. Its measured output, called optical density, is based on the logarithm of the optical reflectance of the image and correlates well with visually perceived lightness or darkness. The results of the optical densities of the imaged areas printed on the recording elements are shown below.

TABLE 1

Color Density of Printed Area of the Elements

| Element | Black | Yellow | Magenta | Cyan |
|---|---|---|---|---|
| Example 1 | 1.77 | 1.70 | 2.01 | 2.01 |
| Example 2 | 1.82 | 1.73 | 2.10 | 2.06 |
| Comp. Example 1 | 1.42 | 1.10 | 1.35 | 1.59 |
| Comp. Example 2 | 0.73 | 0.54 | 0.89 | 1.12 |

The above data show that Examples 1 and 2 of the invention have images with higher optical densities in comparison to the comparative Examples.

The dried prints were immersed in distilled water for 5 min, then dried. The color density of the samples was measured again and the following results were obtained:

TABLE 2

Color Retention (%) of the Elements

| Element | Black | Yellow | Magenta | Cyan |
|---|---|---|---|---|
| Example 1 | 99 | 101 | 99 | 100 |
| Example 2 | 100 | 102 | 98 | 101 |
| Comp. Example 1 | 40 | 36 | 52 | 44 |
| Comp. Example 2 | 67 | 48 | 76 | 79 |

The above data show that the Examples of the invention had a much improved color retention in comparison to the comparative Examples.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising the following layers in the order recited:

I) a solvent-absorbing layer of a porous, polyolefin material, and

II) an image-recording layer comprising a polymeric binder and colloidal silica, wherein all colloidal silica in said image-recording layer consists of colloidal silica having an attached silane coupling agent.

2. The element of claim 1 wherein said porous, polyolefin material is a microporous material comprising:

(a) a matrix of polyolefin;

(b) finely-divided, substantially water-insoluble filler particles distributed throughout said matrix and constituting from about 40 to about 90 percent by weight of said microporous material; and (c) a network of interconnecting pores communicating substantially throughout said microporous material, said pores constituting from about 35 to about 95 percent by volume of said microporous material.

3. The element of claim 2 wherein said filler particles are at least about 50 percent by weight siliceous particles.

4. The element of claim 3 wherein said siliceous particles are silica particles.

5. The element of claim 2 wherein a support has thereon said microporous material.

6. The element of claim 5 wherein said microporous material is laminated to said support.

7. The element of claim 1 wherein said colloidal silica having an attached silane coupling agent has the formula:

$$(R^1)_nSi(OR^2)_{4-n}$$

wherein:

each $R^1$ independently represents a substituted or unsubstituted alkyl group having from 1 to about 10 carbon atoms, at least one $R^1$ having at least one amino group;

each $R^2$ independently represents an alkyl group having from 1 to about 4 carbon atoms; and n is from 1 to 3.

8. The element of claim 7 wherein $R^1$ is $H_2NCH_2CH_2HN(CH_2)_3$ and $CH_3$, each $R^2$ is $CH_3$ and n is 2.

9. The element of claim 1 wherein said porous, polyolefin material comprises an essentially linear ultrahigh molecular weight polyethylene having an intrinsic viscosity of at least about 10 deciliters/gram, an essentially linear ultrahigh molecular weight polypropylene having an intrinsic viscosity of at least about 6 deciliters/gram, or a mixture thereof.

10. The element of claim 1 wherein said image-recording layer is present in an amount of from about 1 to about 40 $g/m^2$.

11. The element of claim 1 wherein said colloidal silica having an attached silane coupling agent comprises at least 70% by weight of said image-recording layer.

12. The element of claim 1 wherein said polymeric binder comprises a water-soluble or water-dispersible polymer.

13. The element of claim 1 wherein said polymeric binder is a polyamide, a polyethyleneimine, a polyacrylamide, a cationic-modified polyvinyl alcohol, a polyvinyl pyridine, an amino-substituted polyacrylate, an amino-substituted polyether or an amino-substituted polyester.

14. The element of claim 1 wherein said image-recording layer also contains a mordant which is a dimethylamino ethyl methacrylate copolymer; poly(vinyl benzyl trimethyl ammonium chloride); poly(diallyl dimethyl ammonium chloride); or poly(methacryloxyethyl hydroxy ethyl dimethyl ammonium chloride) quaternary copolymer.

15. The element of claim 1 wherein the dry thickness of said image-recording layer is from about 0.5 to about 20 $\mu$m.

16. An ink jet printing process comprising:

a) providing an ink jet recording element according to claim 1, and b) applying liquid ink droplets thereon in an image-wise manner.

17. The process of claim 16 wherein said porous, polyolefin material is a microporous material comprising:

(a) a matrix of polyolefin;

(b) finely-divided, substantially water-insoluble filler particles distributed throughout said matrix and constituting from about 40 to about 90 percent by weight of said microporous material; and (c) a network of interconnecting pores communicating substantially throughout said microporous material, said pores constituting from about 35 to about 95 percent by volume of said microporous material.

18. The process of claim 17 wherein said filler particles are at least about 50 percent by weight silica particles.

19. The process of claim 16 wherein said colloidal silica having an attached silane coupling agent has the formula:

$$(R^1)_n Si(OR^2)_{4-n}$$

wherein:

each $R^1$ independently represents a substituted or unsubstituted alkyl group having from 1 to about 10 carbon atoms, at least one $R^1$ having at least one amino group;

each $R^2$ independently represents an alkyl group having from 1 to about 4 carbon atoms; and n is from 1 to 3.

20. The process of claim 19 wherein $R^1$ is $H_2NCH_2CH_2HN(CH_2)_3$ and $CH_3$, each $R^2$ is $CH_3$ and n is 2.

* * * * *